US005456218A

United States Patent [19]

Theorell

[11] Patent Number: 5,456,218

[45] Date of Patent: Oct. 10, 1995

[54] EXPANSION TANK FOR THE COOLING SYSTEM OF AN INTERNAL COMBUSTION ENGINE

[75] Inventor: Gunnar Theorell, Lerum, Sweden

[73] Assignee: AB Volvo, Sweden

[21] Appl. No.: 211,112

[22] PCT Filed: Sep. 10, 1992

[86] PCT No.: PCT/SE92/00623

§ 371 Date: Mar. 21, 1994

§ 102(e) Date: Mar. 21, 1994

[87] PCT Pub. No.: WO93/06365

PCT Pub. Date: Apr. 1, 1993

[30] Foreign Application Priority Data

Sep. 20, 1991 [SE] Sweden ..... 9102716

[51] Int. Cl.[6] ..... F01P 3/22

[52] U.S. Cl. ..... 123/41.54; 165/104.32

[58] Field of Search ..... 123/41.54; 165/104.32

[56] References Cited

U.S. PATENT DOCUMENTS 4,130,159 12/1978 Ohta et al. ..... 123/41.54

5,219,022 6/1993 Martenas et al. ..... 123/41.54

FOREIGN PATENT DOCUMENTS 1254908 11/1967 Germany ..... 165/64.32

3517715 11/1986 Germany .

3533095 3/1987 Germany .

*Primary Examiner*—Noah P. Kamen

*Attorney, Agent, or Firm*—Lerner, David, Littenberg, Krumholz & Mentlik

[57] ABSTRACT

A combination tank for a cooling system of water-cool internal combustion engine includes a storage tank and an expansion tank. The storage and expansion tanks house in a common container tank, so that the storage tank and the expansion tank are disposed adjacent each other in a substantially horizontal plane and separated from one another by a substantially vertical partition wall. The storage tank has a filler opening. An overflow channel internally connects the storage tank and the extension tank. The overflow channel is situated within the partition wall and is integrally formed with and positioned at an upper part of the filler opening.

14 Claims, 3 Drawing Sheets

EXPANSION TANK FOR THE COOLING SYSTEM OF AN INTERNAL COMBUSTION ENGINE

TECHNICAL FIELD

The present invention relates to a combined storage tank and expansion tank arrangement for a water-cooled internal combustion engine cooling system, whereby the storage tank which is provided with a filler opening and the expansion tank are housed in a common container tank made from two moulded plastic parts, with the storage tank and expansion tank internally connected via a vertically disposed overflow channel.

BACKGROUND OF THE INVENTION

The above-described cooling system with a storage tank for the cooling liquid and a separate expansion tank for the expansion of the liquid during warming-up is used for example on heavier trucks and buses where very high functional safety requirements are imposed.

Where the available height is restricted, it has been usual to use separate tanks which are mounted by brackets and connected together by means of tubes and tube clamps. This implies that a relatively large number of components have to be stored and assembled during the production of a vehicle. Since it is desirable to reduce the number of assembly components, combined storage tanks and expansion tanks forming a common container tank are now becoming available. This rationalization is most effective if the container tank is made from two injection-moulded plastic halves which are welded together to form a finished unit with all necessary functions integrated within the two halves.

Such a container tank is shown in DE OS 35 33 095, whereby the storage tank and the expansion tank are connected via a centrally located overflow channel. A disadvantage with this arrangement, i.e. that leakage can arise between the two chambers, has been solved by the provision of a double walled partition wall between the two chambers, whereby infiltration is indicated by leakage of liquid through overflow holes in the double walled cavity.

TECHNICAL PROBLEM

An object of the present invention is thus to provide a container tank for cooling liquid with minimal installation dimensions, with which the cooling system can be tested in a more reliable manner using pressurized air.

SOLUTION

This object is achieved according to the invention by means of the overflow channel being integral with and connected to the filler opening of the storage tank. By means of this arrangement a hermetical test can be easily performed after affixing a test instrument in the filler opening instead of to the filler cap. In this manner the cooling system can be pressure-tested with the exclusion of the expansion tank. Thereafter the connection to the expansion tank can be opened and the entire system can then be pressure-tested.

Advantageous embodiments to the invention will be apparent from the dependent claims.

BRIEF DESCRIPTION OF THE DRAWINGS

An embodiment of the invention will now be described in more detail with reference to the attached drawings, in which.

BEST MODE OF CARRYING OUT THE INVENTION

Figure 1:
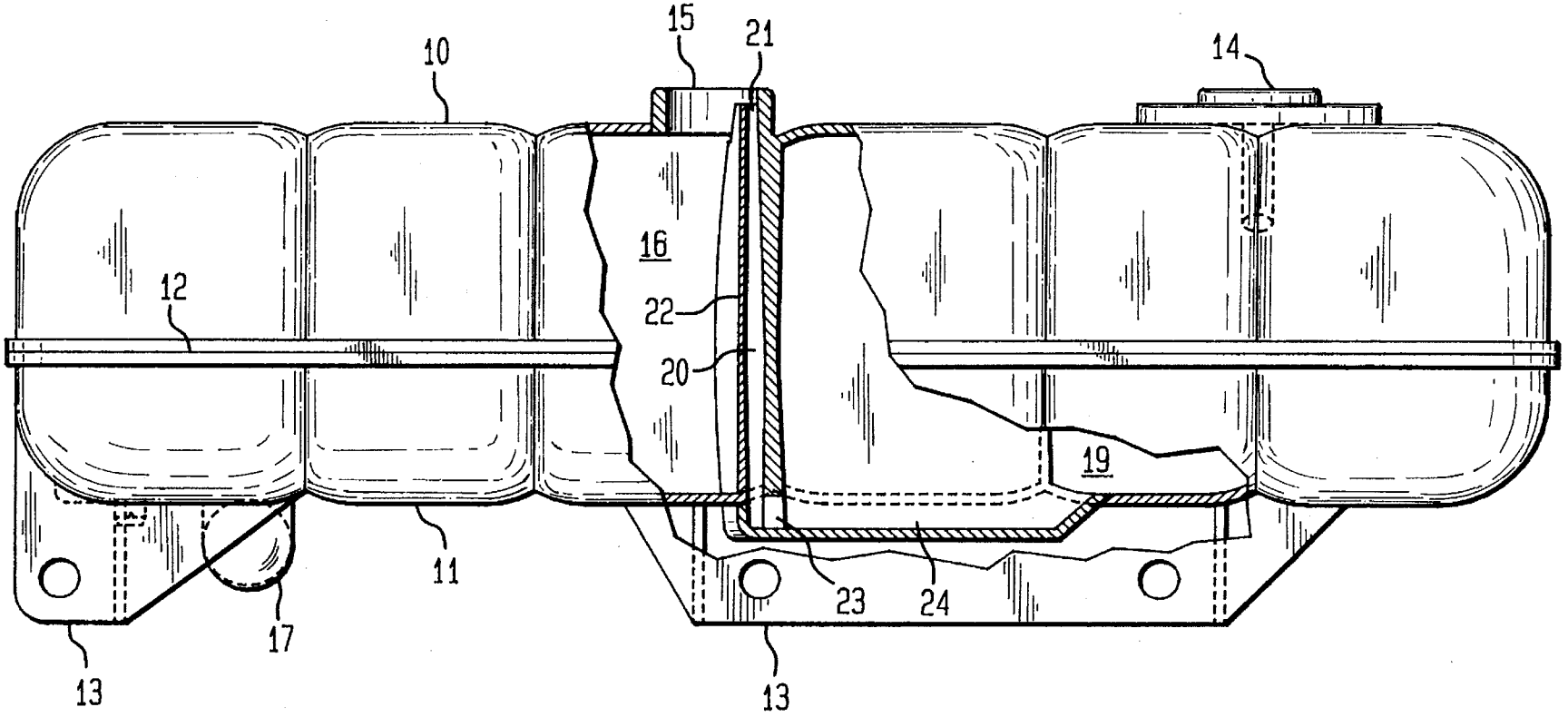
FIG. 1 is a side view of a container tank according to the invention with a partially sectioned wall.

The container tank shown in the drawings is assembled from two tank halves 10, 11 with the joint line 12 extending in a horizontal plane. The two halves 10, 11 are suitably made by injection-moulding of a propene plastic and are joined together by heat welding.

The container tank is provided with moulded brackets 13 for direct mounting in the engine compartment of a vehicle and includes two separate chambers, each having an opening 14 and 15. The one chamber 16 forms the storage tank for the cooling liquid in the cooling system and is connected to the not shown cooling system via a base outlet 17 and two breather pipes 18. The other chamber 19 forms an expansion tank for the storage tank 16 and is connected thereto via an overflow channel 20 which extends between the upper portion of the storage tank 16 and the lower portion of the expansion tank 19.

Figure 2:
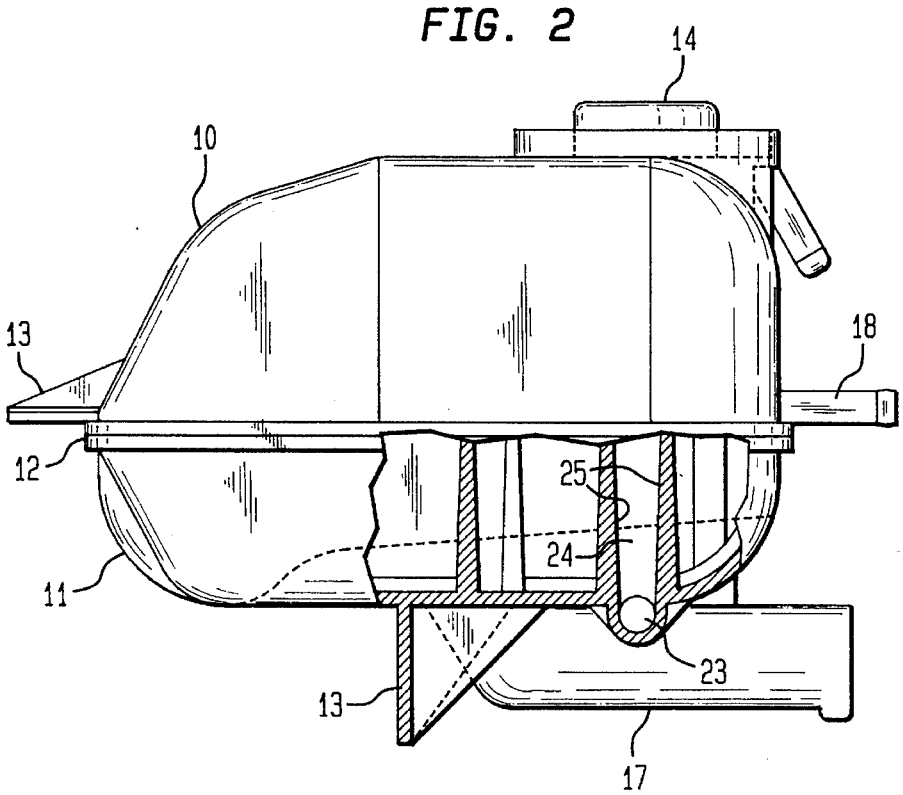
FIG. 2 is a corresponding end view of the container tank, and FIG. 3, 4 show in broken plan views the interior of the cover and base of the container tank.
Figure 3:
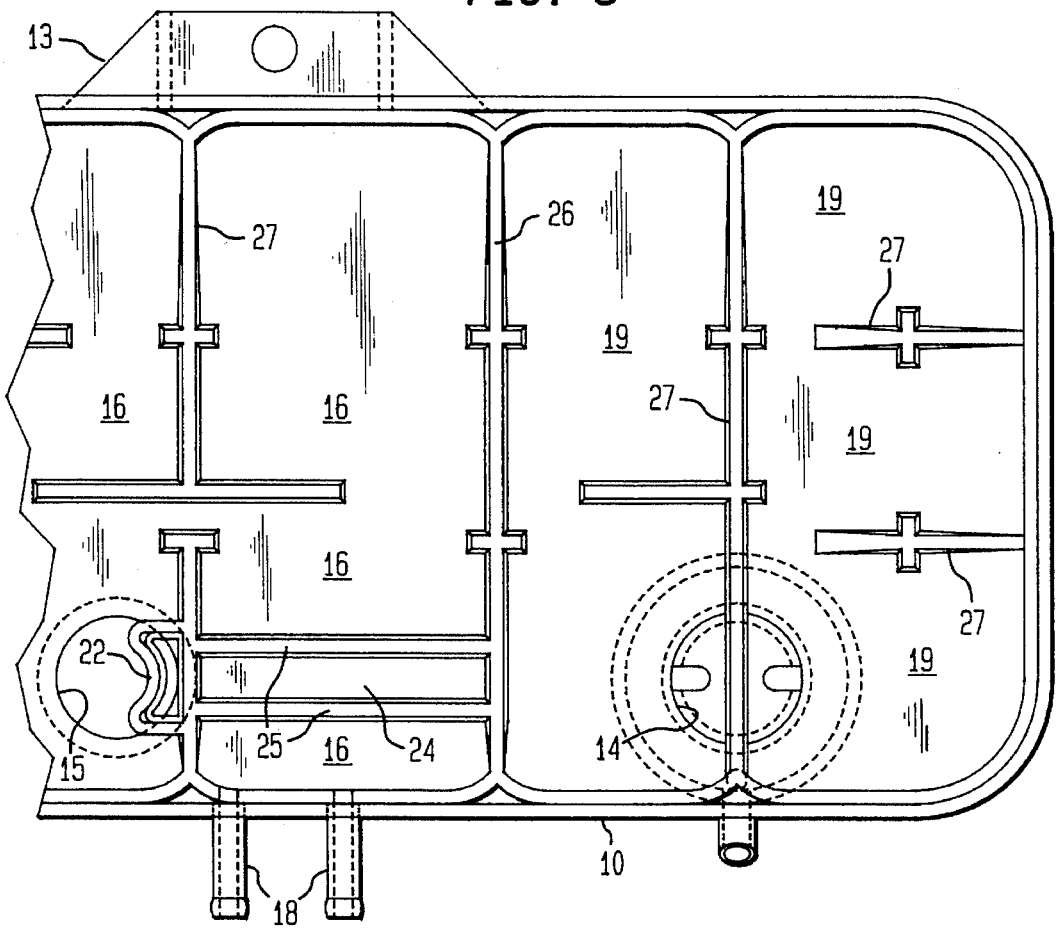
Figure 4:
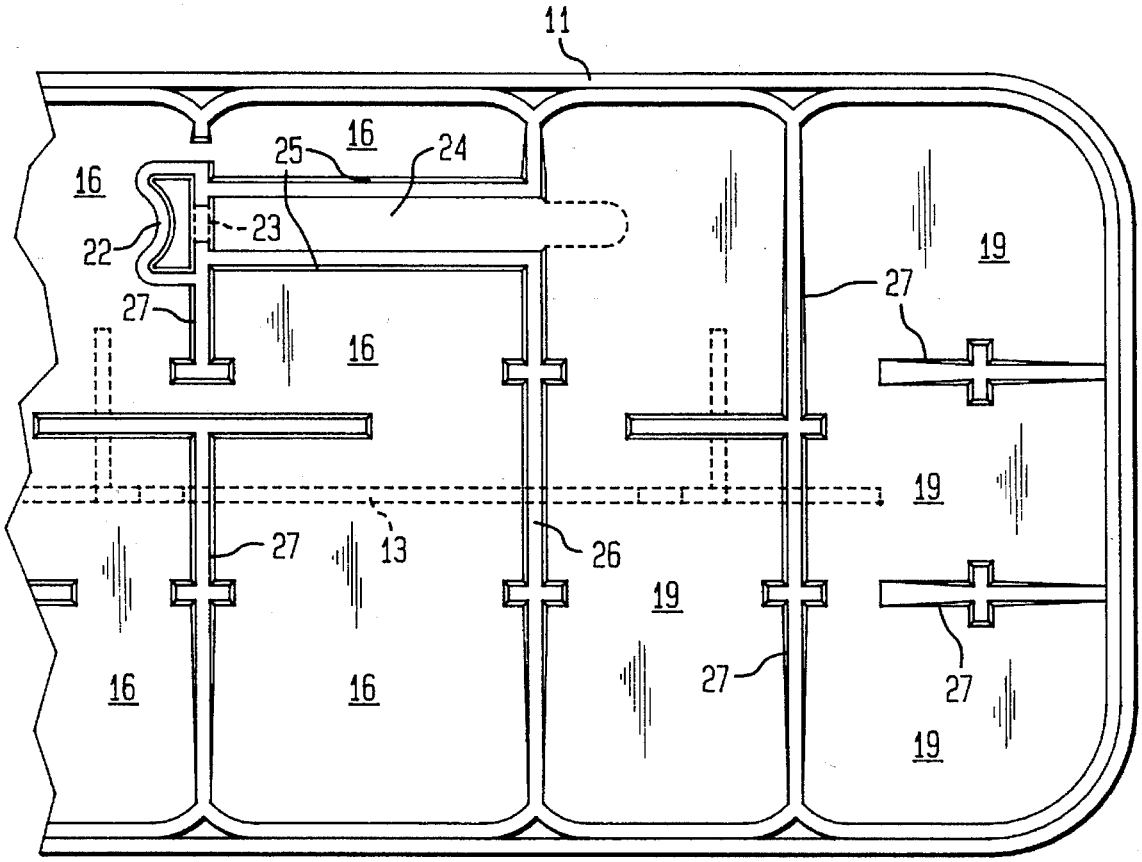

As best shown in FIGS. 1 and 2, the overflow channel 20 is in the form of a flattened pipe 22 which extends between an opening 21 in the throat of the filler opening 15 of the storage tank 16 down to an opening 23 which is located below the level of the bottom of the tank in a narrow trough compartment 24. The compartment 24 further extends upwardly into the container tank between two side walls 25 which, together with the tube 22 and a transverse wall 26, form the partition wall between the storage tank 16 and the expansion tank 19. Further inner longitudinal and transverse walls 27 in the storage tank 16 and the expansion tank 19 serve as anti-surge walls and reinforcement.

When the container tank is functionally connected to the cooling system, the above described overflow channel will then serve as an evacuation path for air from the storage tank to the expansion tank 19. For this purpose the opening 14 to the expansion tank is provided with a special cap which is not shown in the drawings but is well known to the skilled man. Such a cap serves as a back valve, i.e. it prevents reduced pressure from arising within the expansion tank 19 by admitting atmospheric air from outside via a valve passage 28. At the same time the cap prevents air from being evacuated from the container tank except when in an extreme situation the pressure exceeds a predetermined level.

When the temperature in the cooling system rises the volume of the cooling liquid will expand which results in a compression of the air in the expansion tank 19. This compression normally continues until the storage tank 16 is totally emptied of air. This is possible by placing the opening 21 to the overflow channel 20 at a high location in the throat of the filler opening 15. With further heating from the motor, the cooling liquid and air is forced from the storage tank to the expansion tank via the overflow channel 20.

When the temperature in the cooling system drops once again, the volume of the cooling water will reduce. When the pressure drops the cooling liquid in the expansion tank 19 will be drawn/pushed back to the storage tank 16 by means of a siphoning effect via the overflow channel 20. Since the overflow channel 20 opens into a narrow trough at the base of the container tank, the quantity of cooling liquid which cannot be transferred back to the storage tank 16 will be very little. This means that the cooling liquid in the system is utilized to the full.

A hermetical test of the entire cooling system can easily be performed after affixing a test instrument in the filler opening 15 instead of to the filler cap. The test instrument is suitably so shaped that it sealingly abuts both the opening 15 and the opening 21. In this manner the cooling system can be pressure-tested independently of the expansion tank 19. Thereafter a connection to the expansion tank via the opening 21 can be opened and the entire system can then be pressure-tested. If during the first pressure testing the cooling system can withstand a considerably higher pressure than the maximum pressure for the expansion tank, it can be concluded that there is no leakage between the storage tank and the expansion tank. It is therefore very simple to perform a functional test even if the container tank has become opaque due to dirt and ageing.

Although a specific embodiment to the invention has been shown in the drawings it is to be understood that further alternatives and modifications are possible within the scope of the claims.

I claim:

1. A combination tank for a cooling system of a water-cooled internal combustion engine, comprising a storage tank and an expansion tank, said storage and expansion tanks housed in a common container tank, so that said storage tank and said expansion tank being disposed adjacent each other in a substantially horizontal plane and separated from one another by a substantially vertical partition wall, said storage tank having a filler opening, an overflow channel internally connecting said storage tank and said expansion tank, wherein said overflow channel situated within said partition wall being integral with and positioned at an upper part of said filler opening.

2. The combination tank of claim 1, wherein said filler opening is substantially centrally located on said common container tank.

3. The combination tank of claim 1, wherein said common container tank includes an upper wall, a lower wall with a trough compartment, said overflow channel has a lower opening discharging in said trough compartment.

4. The combination tank of claim 3, wherein said lower opening of the overflow channel opens up into a region formed between two substantially vertical walls extending upwardly on either side of said trough compartment.

5. The combination tank of claim 1, wherein said overflow channel further comprises an upper opening, said upper opening opens up at a level above an upper wall of said common container tank.

6. The combination tank of claim 1, wherein the filler opening is formed with an upper primary sealing surface and a secondary sealing surface arranged therebelow, a pressure-testing instrument being placed against said secondary sealing surface for pressure testing of the storage tank and parts of the cooling system excluding the expansion tank.

7. The combination tank of claim 1, wherein said common container tank is made from two molded plastic parts.

8. A combination tank for a cooling system of a water-cooled internal combustion engine, comprising a storage tank and an expansion tank separated by a partition and housed in a common container tank, said storage tank having a filler opening, an overflow channel comprising an upper part and a lower part, said overflow channel internally connecting said storage tank and said expansion tank in such a manner that said upper part being integral with said filler opening and said lower part opens up into said partition; and a trough compartment situated at the bottom of said container tank and between two substantially vertical side walls forming said partition, said lower end of said overflow channel being connected to said through compartment.

9. The combination tank of claim 8 wherein said container tank is made from two molded plastic parts.

10. The combination tank of claim 8 wherein said filler opening is centrally located within said container tank.

11. The combination tank of claim 8, wherein said filler opening is formed with an upper primary sealing surface and a secondary sealing surface, whereby a pressure-testing instrument is sealingly placed against said secondary sealing surface to pressure test the storage tank.

12. The combination tank of claim 11, wherein said pressure-testing instrument is adapted for pressure testing of said cooling system of the internal combustion engine with exception of the expansion tank.

13. The combination of claim 8, wherein said side walls of the partition extend substantially upwardly from both sides of said trough compartment.

14. A combination tank for a cooling system of a water-cooled internal combustion engine, comprising a storage tank and an expansion tank separated by a partition and housed in a common container tank, said common tank formed with at least an upper wall, said storage tank having a filler opening, an overflow channel comprising an upper part and a lower part, said overflow channel internally connecting said storage tank and said expansion tank in such a manner that said upper part being integral with said filler opening and said lower part opens up into said partition;

wherein said upper part of the overflow channel is positioned above said upper wall of the container tank.

* * * * *